United States Patent [19]

Kane

[11] Patent Number: 4,478,402

[45] Date of Patent: Oct. 23, 1984

[54] NIP DRIVE FOR SHEET FEEDING APPARATUS

[75] Inventor: James L. Kane, Rochester, N.Y.

[73] Assignee: Eastman Kodak Company, Rochester, N.Y.

[21] Appl. No.: 464,290

[22] Filed: Feb. 7, 1983

[51] Int. Cl.[3] ..... B65H 3/08

[52] U.S. Cl. ..... 271/100; 271/267; 271/274

[58] Field of Search ..... 271/100, 101, 107, 274, 271/226, 228, 267

[56] References Cited

U.S. PATENT DOCUMENTS

| | | | |
|---|---|---|---|
| 1,45,887 | 8/1923 | Winkler | 271/100 |
| 994,376 | 6/1911 | Cooley | 271/101 |
| 2,767,982 | 10/1956 | Noon | 271/274 X |
| 3,073,590 | 1/1963 | Romeo | 271/274 |
| 3,288,461 | 11/1966 | Smith . | |
| 3,851,871 | 12/1974 | Aronson . | |
| 4,163,550 | 8/1979 | Armstrong | 271/274 |
| 4,257,587 | 3/1981 | Smith . | |
| 4,266,762 | 5/1981 | Kramer et al. . | |

*Primary Examiner*—Richard A. Schacher
*Attorney, Agent, or Firm*—Lawrence P. Kessler

[57] ABSTRACT

An improved nip drive for sheet feeding apparatus having an oscillating vacuum feeder for feeding sheets seriatim along a travel path. The feeder oscillates between a first position adjacent to an entrance to the sheet travel path, where a sheet is tacked to the feeder, and a second position downstream thereof along the travel path. The improved nip drive is adjustably engageable with the feeder, at spaced locations transversely to such path, for advancing a sheet along the travel path while the feeder oscillates. The nip drive is effected by a flexible drive shaft operatively coupled to such nip drive.

10 Claims, 4 Drawing Figures

NIP DRIVE FOR SHEET FEEDING APPARATUS

BACKGROUND OF THE INVENTION

This invention relates generally to sheet feeding apparatus, and more particularly to an improved nip drive for an oscillating vacuum sheet feeder.

A typical apparatus in common use for feeding sheets is an oscillating vacuum feeder such as shown in U.S. Pat. No. 3,851,871, issued Dec. 3, 1974, to Aronson. In the apparatus of such patent, sheets are withdrawn seriatim from a stack by a ported oscillating cylinder coupled to a vacuum source. A sheet is vacuum tackled to the cylinder, with its ports in juxaposition with the sheet stack, and the cylinder rotates in a first direction to withdraw the tacked sheet from the stack and deliver the sheet into a sheet travel path. A pair of nip rollers, in juxtaposition with bearings supported on the cylinder, urge the withdrawn sheet, delivered into the nip, along the travel path. As the sheet is being urged along the path by the nip rollers, the cylinder rotates in the opposite direction to return to its position for withdrawing the next sheet from the stack.

While feeders of this type have proven generally effective in reliably removing sheets seriatim from a stack, each of the nip rollers must transmit equal driving forces on a sheet to avoid skewing of the sheet as it is transported along the travel path. In practice however, unequal driving forces are common due, at least in part, to the rigid interconnection provided between the nip rollers of such prior feeders.

SUMMARY OF THE INVENTION

This invention is directed to an improved nip drive for sheet feeding apparatus having an oscillating vacuum feeder for feeding sheets seriatim along a travel path. The feeder oscillates between a first position adjacent to an entrance to the sheet travel path, where a sheet is tacked to the feeder, and a second position downstream thereof along the travel path. The improved nip drive is adjustably engageable with the feeder, at spaced locations transversely to such path, for advancing a sheet along the travel path while the feeder oscillates. The nip drive is effected by a flexible drive shaft operatively coupled to such nip drive.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawings, in which.

DESCRIPTION OF THE PREFERRED EMBODIMENT

Figure 1:
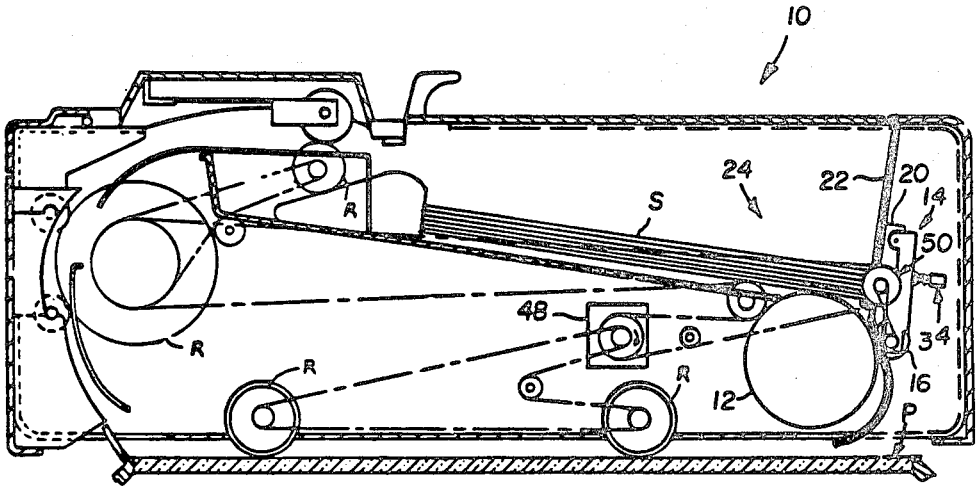
FIG. 1 is a side elevational view, partly in cross-section, of a sheet feeding apparatus including the improved nip drive according to this invention.

Referring now to the accompanying drawings, FIG. 1 shows a sheet feeding apparatus, designated generally by numeral 10 and more fully described in Research Disclosure Bulletin Vol. 46 (April, 1982) at p. 122. The apparatus 10 includes an oscillating vacuum feeder 12 and incorporates the improved skew preventing nip drive 14 according to this invention. The purpose of the apparatus 10 is to circulate information bearing sheets S of a document seriatim about a closed loop travel path across a transparent platen P of an electrographic copier where reflective light images of such sheets are obtained so that the copier can reproduce the information of the sheets. While the apparatus 10 is only intended to be exemplary of sheet feeding apparatus suitable for use with the improved nip drive of this invention, it is typical of apparatus where it is essential that skewing of the fed sheets be controlled or prevented; i.e. the sheets must have a particular (non-skewed) orientation on the platen for proper reproduction, for example.

The improved nip drive 14 comprises a pair of independently supported rollers 16 engageable with bearings 18. Of course, the nip drive may include any suitable number of cooperating rollers and bearings depending upon the transverse dimension of the sheet travel path. The bearings 18 (see FIG. 2) are respectively supported concentrically on the oscillating vacuum feeder 12 at spaced locations along the longitudinal axis of the feeder transverse to the sheet travel path. The independent support for the rollers 16 is provided by mounting blocks 20 secured to the outboard side of the forward guide plate 22 of the supply hopper 24 for the sheets S (see FIG. 3). Pins 28, respectively carried by the blocks 20, pivotally support generally u-shaped channel members 26 adjacent to one end of such channel members. The opposite end of the channels 26 carry rotatable axles 30 upon which the rollers 16 are respectively mounted.

Figure 3:
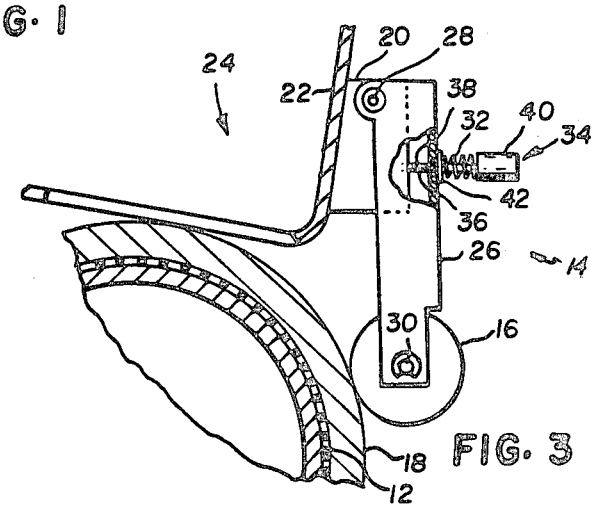
FIG. 3 is a side elevational view, on an enlarged scale, of the improved nip drive according to this invention.

The rollers 16 are respectively urged into engagement with the bearings 18 of the feeder 12 by springs 32. With particular reference to FIG. 3, where one of the pair of rollers and its associated support structure is illustrated, the spring 32 is compressed between channel 26 and its associated stop member 34. The stop member 34 comprises a threaded post 36 mounted at one end in mounting block 20 and passing freely through an opening 38 in channel member 26. An enlarged, internally threaded knob 40 is matably mounted on the post 36. The spring 32 is located about the post 36 and compressed between the knob 40 and washer 42 abutting the channel member 26. Thus the force exerted by the spring 32 urges the roller 16 into engagement with its respective bearing 18. Such urging force can be adjusted by turning the knob 40 to set the optimum driving force of the roller on the fed sheets. Accordingly the driving forces exerted by the rollers 16 are independently adjustable, in the described manner, until such driving forces are substantially equal. As a result sheets fed by the improved nip drive 14 are urged along the travel path with uniform driving forces being applied by each roller, thereby preventing skewing of the sheets as they are fed by the nip drive.

Figure 4:
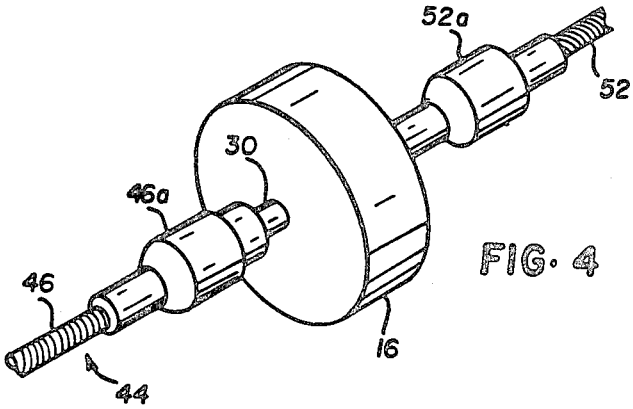
FIG. 4 is a view, in perspective and on an enlarged scale, of a portion of the flexible drive shaft for the nip drive, particularly showing its coupling to a nip drive roller.
Figure 2:
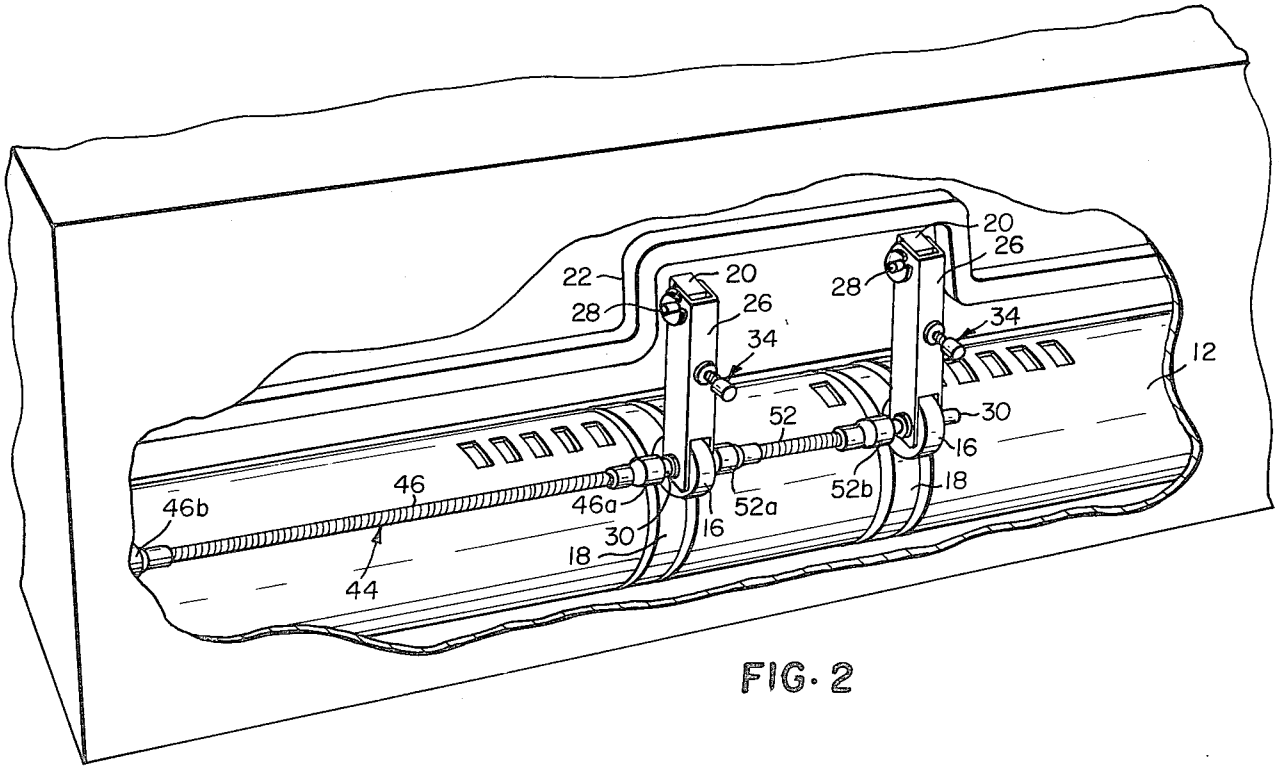
FIG. 2 is a view, in perspective, on an enlarged scale, of a portion of the apparatus of FIG. 1, with portions broken away to facilitate viewing of the improved nip drive.

Drive for the rollers 16 is accomplished through a flexible drive shaft 44 (see FIGS. 2, 4). The drive shaft 44 includes a first flexible section 46. A coupling **46*a*, at one end of the section 46, connects such section to an axle 30 of one roller 16. A similar coupling 46***b*, at the other end of such section, connects such section to a rotary drive source 48 (see FIG. 1). In the illustrative embodiment the source 48 is a motor M for driving rollers R to feed sheets about the closed loop path of the apparatus 10. A pulley and belt power take off 50 from the motor M rotate the shaft section 46. The rollers 16 are interconnected by a second flexible section 52 of the drive shaft 44. The section 52 is connected by couplings 52*a*, 52*b* to the respective axles of the rollers. Flexible section 46 of the drive shaft transmits rotary drive to one roller without requiring precise alignment of its axle and the coupling 46*b* to the source 48. Similarly the flexible section 52 of the drive shaft transmits rotary drive from the axle of such one roller to the other roller while allowing for relative offset in the axes of the axles. Thus, the rollers can be independently adjusted into engagement with respective bearings 18 of the feeder 12 without adversely effecting the drive to the rollers. In this manner the rotary drive is effective to drive the rollers, and at the same time enables the rollers to be independently adjusted to avoid the introduction of skew sheets being fed, as is the case in the rigid drive couplings for nip drives of the prior art.

The invention has been described in detail with particular reference to a preferred embodiment thereof, but it will be understood that variations and modifications can be effected within the spirit and scope of the invention.

I claim:

1. Apparatus for feeding sheets seriatim along a travel path, said apparatus comprising:

rotary means, mounted on one side of such path for rotation about an axis extending transversely across such path, for delivering a sheet into such path;

means for defining a sheet drive nip with said rotary delivering means, said nip defining means including a plurality of rollers, means for independently supporting said rollers on the other side of such path, and means for adjustably urging said rollers independently into continuous engagement with said rotary delivering means; and flexible drive means, operatively coupled to said plurality of rollers, for driving said rollers to advance sheets along such path.

2. The invention of claim 1 wherein said independent support means includes a plurality of mounting blocks supported at spaced locations transverse of such path, and a plurality of members pivotably mounted on said plurality of mounting blocks respectively, said plurality of members supporting said plurality of rollers respectively.

3. The invention of claim 2 wherein said adjustable urging means includes a plurality of adjustable stop members coupled to said plurality of mounting blocks respectively to vary the spacing between such stop members and such blocks, and resilient means supported between said stop members and said pivotable members for urging said rollers into engagement with said rotary delivering means with a force inversely proportional to such spacing.

4. The invention of claim 1 wherein said flexible drive means includes a flexible drive shaft.

5. The invention of claim 1 wherein the axes of rotation of said plurality of rollers are respectively parallel to the axis of rotation of said rotary delivering means, and wherein said flexible drive means includes a flexible drive shaft adapted to be operatively coupled to a rotary power source and one of said plurality of rollers, and an additional flexible drive shaft adapted to operatively couple said one to another of said plurality of rollers, whereby drive is imparted to said rollers regardless of coincidence of said axes of rotation of said rollers.

6. In an apparatus for feeding sheets seriatim from a sheet supply stack into a travel path, said apparatus having a substantially cylindrical vacuum housing supporting a plurality of bearings concentric with said housing at locations spaced along the longitudinal axis of said housing, such longitudinal axis being oriented transverse to the travel path, said housing oscillating between a first position adjacent to the entrance to the travel path where a sheet is attracted from such stack and tacked to said housing for delivery into such path, and a second position along the travel path downstream of the entrance to such path, means for advancing a sheet along such path while said housing oscillates, said sheet advancing means comprising:

means, engageable with said plurality of bearings, for defining a sheet drive nip with such bearings;

means for adjustably controlling the nip engagement pressure of said nip drive defining means on said bearings to effect uniform advancement of a sheet along such path without inducing skew; and flexible drive means, operatively coupled to said nip drive defining means, for effecting drive of said nip drive defining means when such defining means is in engagement with said bearings to advance sheets along such travel path.

7. The invention of claim 6 where said nip drive defining means includes a plurality of rollers; and wherein said nip pressure controlling means includes means for independently supporting said rollers, and means, operatively associated with said supporting means, for adjustably urging said rollers respectively into engagement with said bearings.

8. The invention of claim 7 wherein said support means includes a plurality of mounting blocks supported at spaced locations transverse of such path, and a plurality of members pivotably mounted on said plurality of mounting blocks respectively, said plurality of members including means for rotatably supporting said plurality of rollers respectively.

9. The invention of claim 8 wherein said adjustable urging means includes a plurality of adjustable stop members coupled to said plurality of mounting blocks respectively to vary the spacing between such stop members and such blocks, and resilient means supported between said stop members and said pivotable members for urging said rollers into engagement with said rotary delivering means with a force inversely proportional to such spacing.

10. The invention of claim 7 wherein the axes of rotation of said plurality of rollers are respectively parallel to the axis of rotation of said rotary delivering means, and wherein said flexible drive means includes a flexible drive shaft adapted to be operatively coupled to a rotary power source and one of said plurality of rollers, and an additional flexible drive shaft adapted to operatively couple said one to another of said plurality of rollers, whereby drive is imparted to said rollers regardless of coincidence of said axes of rotation of said rollers.

* * * * *